US008863394B2

(12) United States Patent
Lo

(10) Patent No.: US 8,863,394 B2
(45) Date of Patent: Oct. 21, 2014

(54) FOLDING KNIFE

(76) Inventor: Yen-Fen Lo, Kaohsiung (TW)

( * ) Notice: Subject to any disclaimer, the term of this patent is extended or adjusted under 35 U.S.C. 154(b) by 849 days.

(21) Appl. No.: 13/064,834

(22) Filed: Apr. 20, 2011

(65) Prior Publication Data

US 2012/0180320 A1 Jul. 19, 2012

(30) Foreign Application Priority Data

Jan. 17, 2011 (TW) ..... 100200979 U

(51) Int. Cl.
*B26B 1/04* (2006.01)

(52) U.S. Cl.
CPC ..... *B26B 1/044* (2013.01)
USPC ..... 30/161; 30/155

(58) Field of Classification Search
USPC ..... 30/155, 160, 161
See application file for complete search history.

(56) References Cited

U.S. PATENT DOCUMENTS

| | | | | |
|---|---|---|---|---|
| 5,699,615 | A * | 12/1997 | Chen | 30/160 |
| 5,875,552 | A * | 3/1999 | Chen | 30/161 |
| 6,154,965 | A * | 12/2000 | Sakai | 30/161 |
| 6,276,063 | B1 * | 8/2001 | Chen | 30/161 |
| 6,434,831 | B2 * | 8/2002 | Chen | 30/161 |
| 6,701,621 | B2 * | 3/2004 | Kain et al. | 30/160 |
| 7,165,329 | B2 * | 1/2007 | Kao | 30/161 |
| 7,437,822 | B2 * | 10/2008 | Flagg et al. | 30/161 |
| 7,854,067 | B2 * | 12/2010 | Lake | 30/159 |
| 8,375,589 | B2 * | 2/2013 | Bremer et al. | 30/155 |
| 8,499,460 | B1 * | 8/2013 | Pearman | 30/155 |
| 8,505,206 | B2 * | 8/2013 | VanHoy | 30/159 |
| 2005/0183268 | A1 * | 8/2005 | Chen | 30/161 |
| 2006/0162168 | A1 * | 7/2006 | Kao | 30/161 |
| 2007/0151110 | A1 * | 7/2007 | Chen | 30/155 |
| 2007/0169351 | A1 * | 7/2007 | Steigerwalt | 30/155 |
| 2012/0144677 | A1 * | 6/2012 | Chang | 30/161 |
| 2012/0180320 | A1 * | 7/2012 | Lo | 30/161 |
| 2012/0234142 | A1 * | 9/2012 | Onion | 81/489 |
| 2012/0240412 | A1 * | 9/2012 | Chen | 30/161 |

* cited by examiner

*Primary Examiner* — Hwei C Payer
(74) *Attorney, Agent, or Firm* — Bacon & Thomas, PLLC

(57) ABSTRACT

The present invention is to provide a folding knife having a blade pivotally connected to a handle. A resilient locking arm has a first end fixed inside to the handle and a second end extending slantingly toward the blade when the blade is received in the handle. A positioning plate is movably positioned in the handle, and has a first end extending outside to the handle. Once the blade is received in the handle, the positioning plate engages with the resilient locking arm. However, when the blade is rotated out of the handle completely, the second end of the resilient locking arm presses against the end of the blade in a locked position, and thereby the positioning plate disengages with the resilient locking arm and presses against the resilient locking arm to avoid the blade from being out of the locked position and rotated into the handle.

16 Claims, 4 Drawing Sheets

FOLDING KNIFE

FIELD OF THE INVENTION

The present invention relates a folding knife, more particularly to a folding knife having a positioning plate movably positioned in a handle thereof, wherein the positioning plate engages with a resilient locking arm inside the handle when the blade is received in the handle. However, when the blade is rotated out of the handle completely, an end of the resilient locking arm presses against the end of the blade in a locked position, and thereby the positioning plate disengages with the resilient locking arm and presses against the resilient locking arm to avoid the blade from being out of the locked position and rotated into the handle

BACKGROUND OF THE INVENTION

Recently, with the advancement of craft techniques and the improvement of living standards, people who intend to buy a new product consider not only the price and durability of the product, but also whether the product is convenient and safe to use. Such a change in market trends has driven manufacturers and designers in all fields to develop new and better products on a regular basis so as to meet consumers' needs. Take the folding knife commonly used in outdoor recreational activities for example. The conventional folding knife is provided with a resilient locking arm in the handle. When the blade of the folding knife is received in the handle, the resilient locking arm is movably pressed against a lateral side of the blade. Once the blade is rotated out of the handle completely, the end of the resilient locking arm that slants toward the inside of the blade is movably pressed against one end of the blade. Thus, the resilient locking arm holds the blade in place and increases the stability of the folding knife in use. However, as the resilient locking arm is installed in the handle in a movable manner, the aforesaid end of the resilient locking arm may deform and therefore fail to press against the blade when the blade is subjected to an excessively large force. Should it happen, the user is very likely to be accidentally cut by the blade. To solve this problem, improved folding knife structures that feature enhanced stability in use were proposed.

For example, referring to FIG. 1 for a folding knife disclosed in U.S. Pat. No. 7,437,822B2, the folding knife 1 includes a blade 11, a handle 13, and a pushing device 15. The handle 13 includes a first panel 131, a second panel 132, and a third panel 133. The panels 131, 132, 133 are connected together by a pivot 110 passing through the panels at a position adjacent to one end thereof. The pivot 110 also extends through the blade 11 such that a portion of the blade 11 that is adjacent to one end thereof is fixed in position between the first panel 131 and the second panel 132. The second panel 132 is provided with a resilient locking arm 132*a* which has a first end fixed to the second panel 132 and a second end extending slantingly toward the first panel 131. Hence, while the blade 11 is being rotated out of the handle 13 from a first side thereof, a lateral surface of the resilient locking arm 132*a* is pressed against a lateral surface of the blade 11, and once the blade 11 is rotated out of the handle 13 completely, the second end of the resilient locking arm 132*a* is pressed against the aforesaid end of the blade 11 to prevent the blade 11 from rotating back toward the handle 13. The third panel 133 is concavely provided with a receiving groove 133*a*. A post 133*b* is provided in the receiving groove 133*a* and is adjacent to a first end thereof. The pushing device 15 consists of a pushing element 151 and a restoring spring 152. The pushing element 151 corresponds in configuration to a portion of the receiving groove 133*a* that is adjacent to a second end thereof. Thus, with the pivot 110 passing through the middle portion of the pushing element 151, the pushing element 151 not only can be received in a second end of the receiving groove 133*a*, but also can be rotated therein about the pivot 110. The pushing element 151 further has a projection 151*a* and a pushing portion 151*b*, wherein the projection 151*a* projects toward the second panel 132, and the pushing portion 151*b* extends outward of the handle 13. The restoring spring 152 has a first end that corresponds in configuration to and is positioned in the first end of the receiving groove 133*a*. The middle portion of the restoring spring 152 is wound around the periphery of the post 133*b*. A second end of the restoring spring 152 extends toward the second end of the receiving groove 133*a* and is pressed against the projection 151*a* of the pushing element 151 such that the projection 151*a* is biased toward a second side of the handle 13 and can be moved to a position below the resilient locking arm 132*a*. Therefore, once the blade 11 is rotated out of the handle 13 completely, and the second end of the resilient locking arm 132*a* is pressed against the aforesaid end of the blade 11, the projection 151*a* is pressed against the other lateral surface of the resilient locking arm 132*a* to prevent the resilient locking arm 132*a* from being pressed toward the third panel 133, thereby ensuring the stability of the blade 11 during use. When the folding knife 1 is no longer in use, the blade 11 can be folded into the handle 13 as follows. First, the pushing portion 151*b* is pushed to rotate the projection 151*a* toward the first side of the handle 13 from below the resilient locking arm 132*a*. Then, the resilient locking arm 132*a* is pressed to release the blade 11 from the pressing of the resilient locking arm 132*a*, so that the blade 11 can be rotated into the handle 13. In the conventional folding knife design described above, the projection 151*a* of the pushing element 151 is configured to provide increased support for the resilient locking arm 132*a*, and yet the folding knife 1 still has the following drawbacks:

(1) A complicated overall structure and an elaborate assembly process: During assembly of the folding knife 1, the pushing element 151 must be mounted around the pivot 110 before the first end of the restoring spring 152 is positioned in the first end of the receiving groove 133*a*. Afterward, the restoring spring 152 must be wound around the post 133*b* such that the second end of the restoring spring 152 is pressed against the projection 151*a*. This assembly process is far more complicated than that of the conventional folding knife and demands absolute concentration and patience from the assembly operator. In consequence, the folding knife 1 is very likely to be manufactured at low efficiency and high cost.

(2) Insecureness of the pushing device 15: As the restoring spring 152 is positioned in the receiving groove 133*a* by winding around the post 133*b*, the second end of the restoring spring 152 must be placed precisely against the projection 151*a* in order to bias the pushing element 151. However, when the folding knife 1 is subjected to an external impact, the restoring spring 152 tends to loosen or be shifted in position such that the second end thereof no longer presses against the projection 151*a*, or that the pushing device 15 becomes less responsive to the user's operation. Since durability has always been an important feature expected of folding knives, the aforesaid drawback of the folding knife 1 is highly undesirable.

To sum up, although the projection 151*a* of the pushing element 151 in the folding knife 1 serves to enhance the structural strength of the resilient locking arm 132*a*, the overall structure and the assembly procedure of the folding knife 1 are prohibitively complicated. Moreover, manufacture efficiency and product durability may be compromised when the pushing device 15 is impacted and loosened; in other words, the folding knife 1 does not provide a sound solution to improving the instability of the conventional folding knife during use. Therefore, the issue to be addressed by the present invention is to design a folding knife with a resilient locking arm, wherein the resilient locking arm not only features high structural strength but also ensures durability of the folding knife and can be easily installed so as to lower production costs effectively.

BRIEF SUMMARY OF THE INVENTION

In view of the fact that the resilient locking arm of the conventional folding knife has insufficient structural strength and is hence responsible for accidental folding of the blade and potential cutting injury, the inventor of the present invention put years of practical experience into research and experiment and, after repeated trials and tests, finally succeeded in developing a folding knife as disclosed herein. The disclosed folding knife is intended to provide enhanced stability and safety is use.

It is an object of the present invention to provide a folding knife, wherein the folding knife includes a handle, a blade, and a positioning plate. The handle is composed at least of a first panel, a second panel, and a third panel. The blade is pivotally connected between the first panel and the second panel by a pivot. The second panel is provided with a resilient locking arm. The resilient locking arm has a first end fixed to the handle and a second end extending slantingly toward the first panel. Thus, in the course where the blade is rotated out of the handle, a first lateral surface of the resilient locking arm is pressed against a lateral surface of the blade; once the blade is rotated out of the handle completely, the second end of the resilient locking arm is pressed against an end of the blade to open the blade fully. Besides, the resilient locking arm has a first engaging portion. The positioning plate is movably positioned between the second panel and the third panel and corresponds in position to the resilient locking arm. The positioning plate has a first end extending outward of the handle and a second end. A restoring spring provided between the second end of the positioning plate and the handle is configured to push the positioning plate, causing the positioning plate to move in the longitudinal direction of the resilient locking arm. The positioning plate further has a second engaging portion corresponding in configuration to the first engaging portion. Once the blade is rotated into the handle and received therein, the first engaging portion engages with the second engaging portion. However, when the blade is rotated out of the handle completely, the resilient locking arm is pressed against the aforesaid end of the blade and thereby drives the second engaging portion out of engagement with the first engaging portion. Meanwhile, the restoring spring pushes the positioning plate toward the second end of the resilient locking arm and thereby presses the second engaging portion against a second lateral surface of the resilient locking arm to enhance the structural strength of the resilient locking arm. When it is desired to use the folding knife, the user only has to rotate the blade out of the handle completely, and the restoring spring will push the positioning plate automatically such that the second engaging portion is pressed against the second lateral surface of the resilient locking arm to ensure stability of the blade during use. When it is desired to fold the blade, the first end of the positioning plate is pushed toward the restoring spring, thereby moving the second engaging portion into engagement with the first engaging portion. Then, the resilient locking arm is pressed to release the blade from the pressing force of the resilient locking arm and thereby allow the blade to be rotated into the handle.

It is another object of the present invention to provide the foregoing folding knife, wherein the third panel is formed with a groove corresponding in configuration to the positioning plate. Thus, not only can the positioning plate be moved along the groove in the longitudinal direction of the resilient locking arm, but also the second engaging portion can be moved precisely into engagement with the first engaging portion while the positioning plate is pushed toward the first end of the resilient locking arm, so as for the blade to be received in the handle. Besides, during assembly of the folding knife, the positioning plate can be positioned for operation simply by placing it into the groove, thus simplifying and shortening the assembly process of the folding knife. Furthermore, in order for the restoring spring to push the positioning plate, the restoring spring only needs to be positioned in such a way that it is pressed against the second end of the positioning plate; in other words, it is not necessary to place the restoring spring precisely against the second engaging portion. Therefore, when the folding knife is impacted by an external force, the positioning plate will not experience difficulty in movement simply because the restoring spring is slightly shifted in position. In a nutshell, the durability of the folding knife is enhanced.

BRIEF DESCRIPTION OF THE SEVERAL VIEWS OF THE DRAWINGS

The structure as well as a preferred mode of use, further objects, and advantages of the present invention will be best understood by referring to the following detailed description of an illustrative embodiment in conjunction with the accompanying drawings, in which.

DETAILED DESCRIPTION OF THE INVENTION

Figure 1:
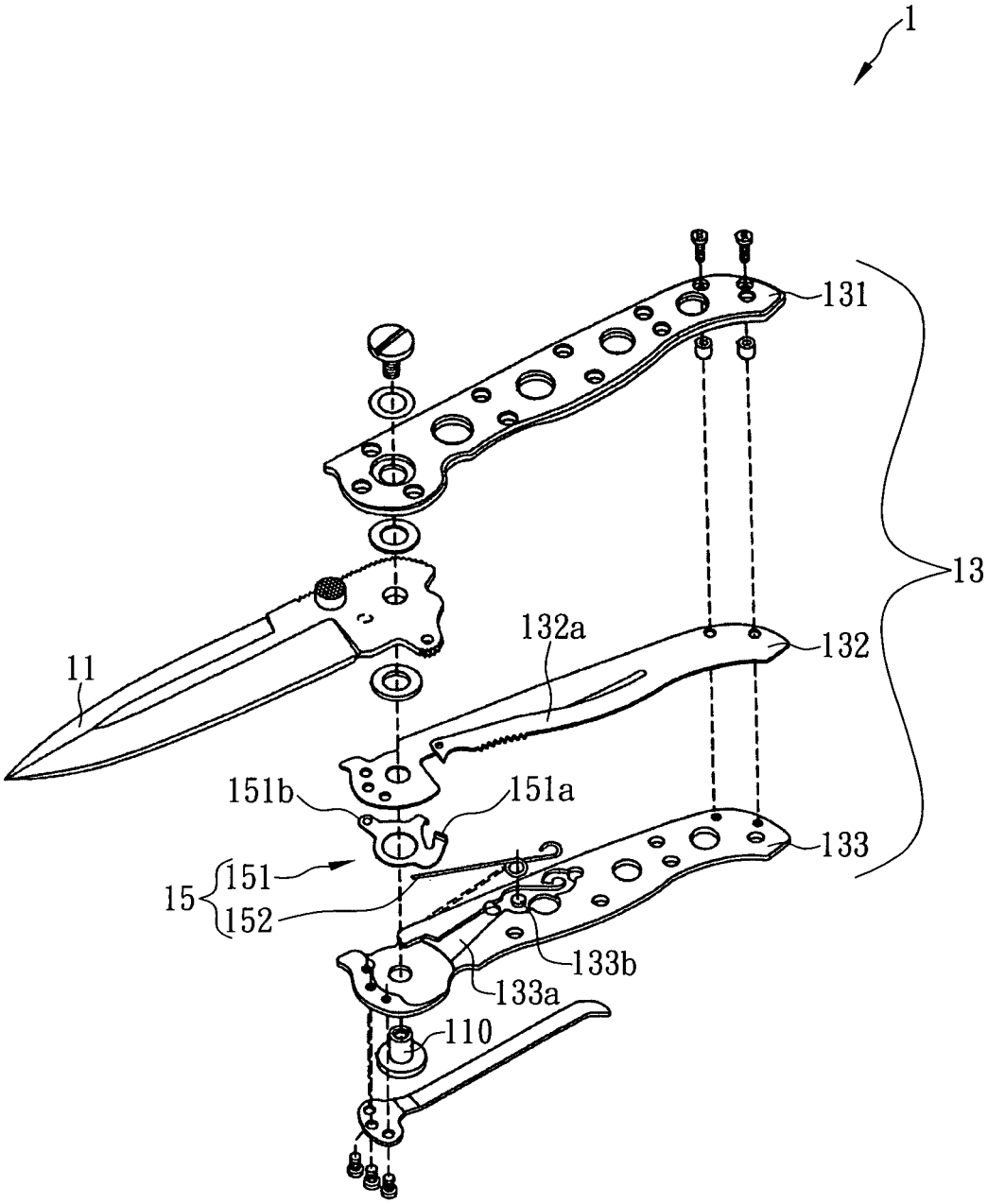
FIG. 1 (Prior Art)
FIG. 1 is an exploded perspective view of a conventional folding knife.
Figure 2:
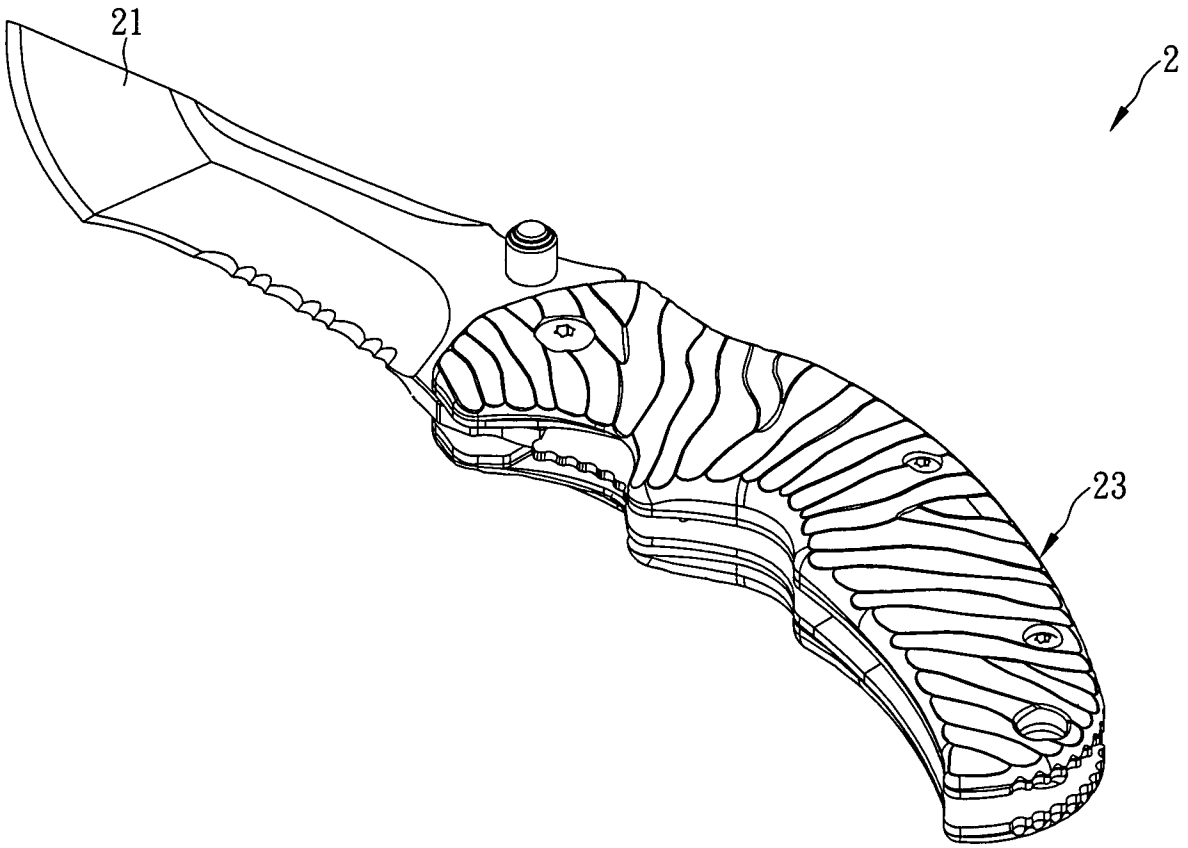
FIG. 2 is a perspective view of a folding knife according to a preferred embodiment of the present invention.
Figure 3:
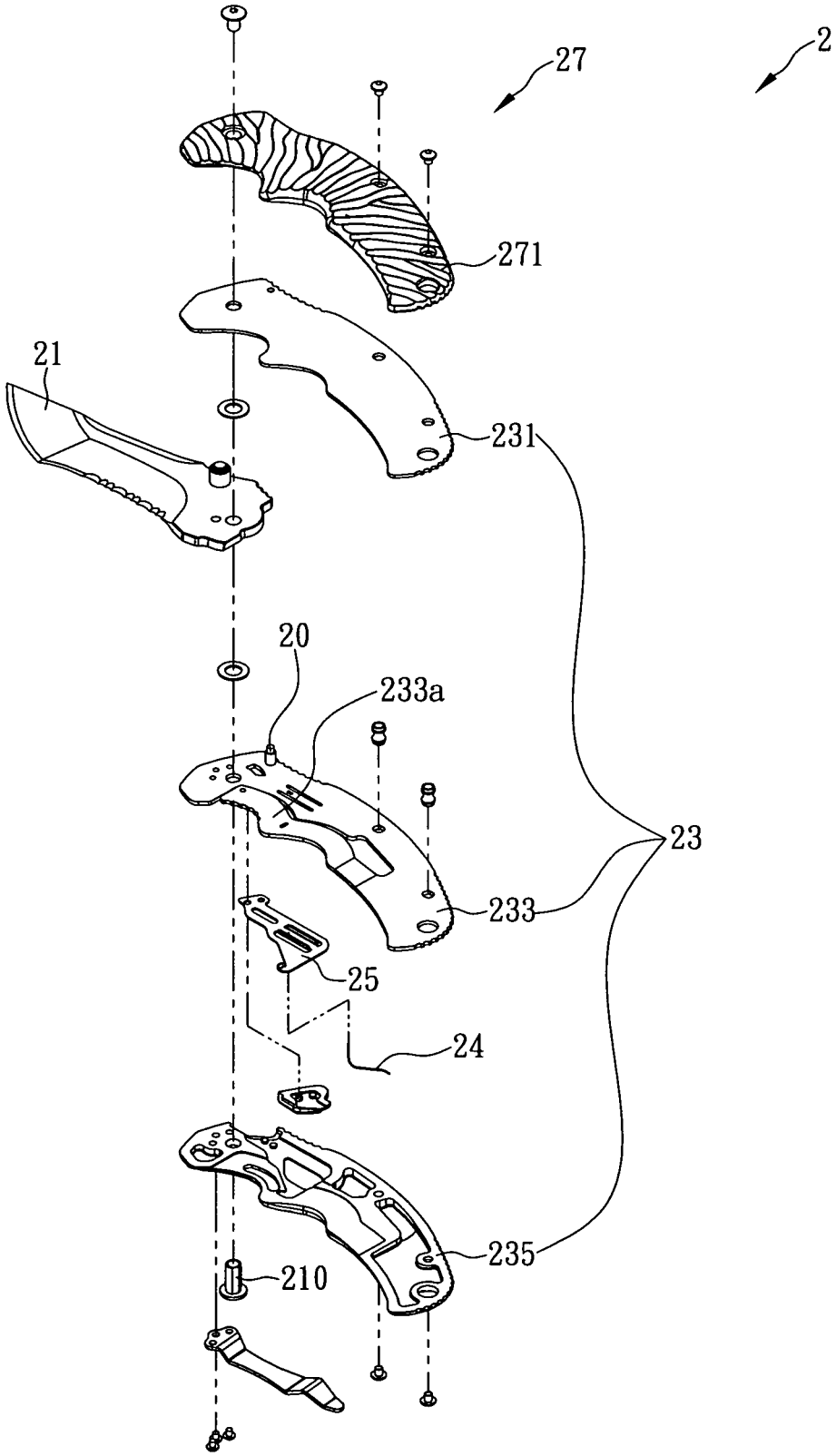
FIG. 3 is an exploded perspective view of the folding knife according to the preferred embodiment of the present invention.

The present invention provides a folding knife. Referring to FIG. 2 and FIG. 3 for a preferred embodiment of the present invention, the folding knife 2 includes a blade 21, a handle 23, and a positioning plate 25. A portion of the blade 21 that is adjacent to a first end thereof is pivotally connected in the handle 23 by a pivot 210. A second end of the blade 21 is pivotable about the pivot 210 and can be rotated out of the handle 23 from a first side thereof or be rotated into and received in the handle 23. The handle 23 is composed at least of a first panel 231, a second panel 233, and a third panel 235. The aforesaid portion of the blade 21 that is adjacent to the first end thereof is positioned between the first panel 231 and the second panel 233 by the pivot 210. The second panel 233 is provided with a post 20 and a resilient locking arm **233*a*. The post 20 is adjacent to one end of the second panel 233 so as to press against the first end of the blade 21 when the blade 21 has been rotated out of the handle 23 completely, thereby preventing the blade 21 from rotating further toward the other side (hereinafter referred to as the second side) of the handle 23. Also, when the blade 21 is fully received in the handle 23, the post 20 presses against one side of the blade 21 such that the blade 21 is positioned in the handle 23. The resilient locking arm 233***a* has a first end fixed to the second panel 233 and corresponding in position to the first side of the handle 23. The other end (hereinafter referred to as the second end) of the resilient locking arm 233*a* extends slantingly toward the first panel 231 such that, while the blade 21 is being rotated out of the handle 23, a first lateral surface of the resilient locking arm 233*a* is pressed against a lateral surface of the blade 21, and once the blade 21 is rotated out of the handle 23 completely, the second end of the resilient locking arm 233*a* is pressed against the first end of the blade 21 to fix the blade 21 in the fully opened state.

Figure 4:
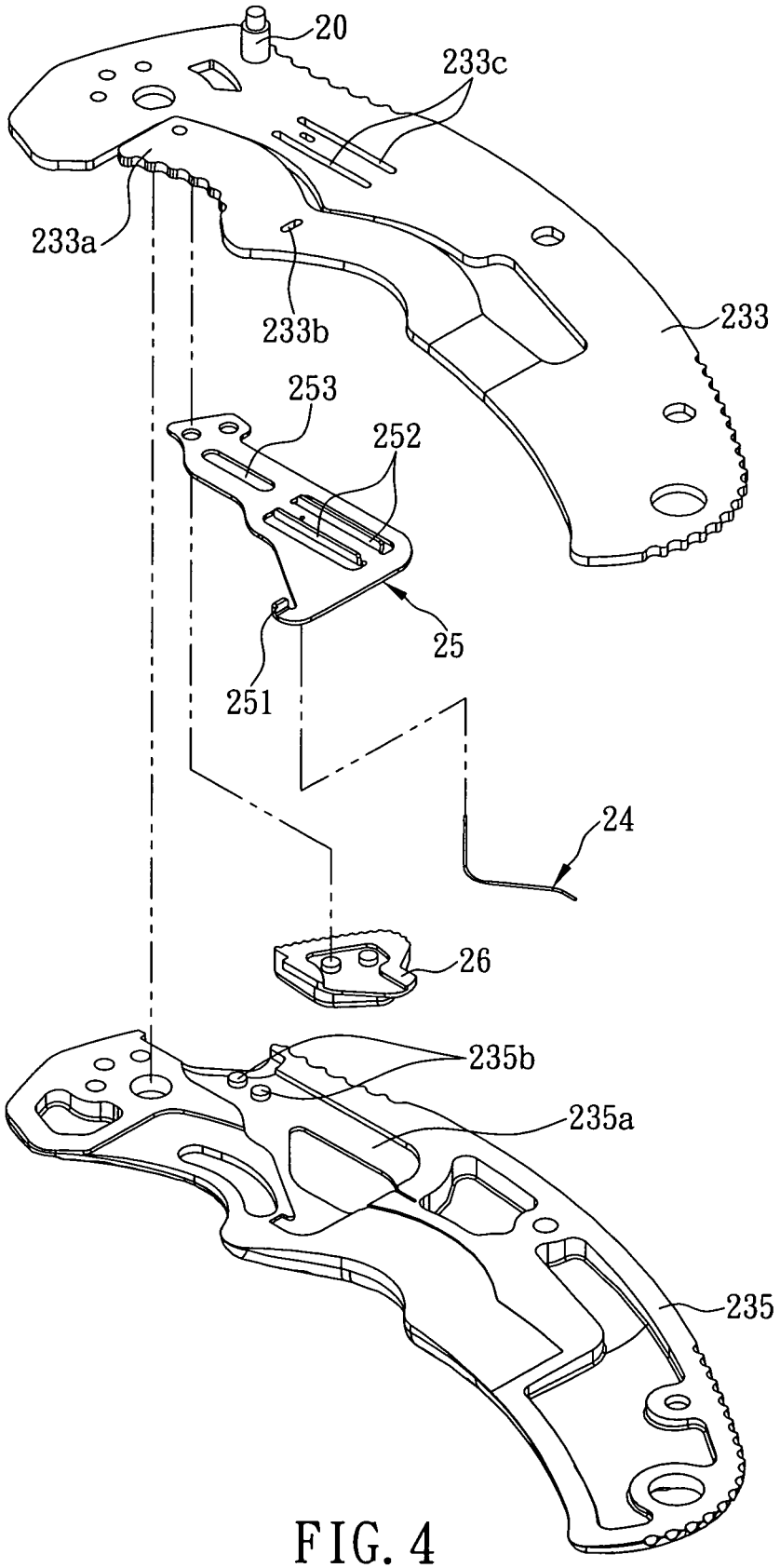
FIG. 4 is a partial exploded perspective view of the folding knife according to the preferred embodiment of the present invention.

Reference is now made to FIG. 4, from which the blade 21, the first panel 231, and some other components of the folding knife 2 are omitted to facilitate illustration so that a person skilled in the art can easily understand the main technical features of the present invention. The resilient locking arm 233*a* has a first engaging portion 233*b* configured as a through hole. The positioning plate 25 is movably positioned between the second panel 233 and the third panel 235, corresponds in position to the resilient locking arm 233*a*, and can be displaced along the longitudinal direction of the resilient locking arm 233*a*. In addition, the positioning plate 25 has a first end jutting out of the handle 23, and a restoring spring 24 is disposed between the other end (hereinafter referred to as the second end) of the positioning plate 25 and the third panel 235. The positioning plate 25 also has a second engaging portion 251 adjacent to the second end of the positioning plate 25. In this embodiment, the second engaging portion 251 is a projection extending toward the resilient locking arm 233*a* and corresponding in configuration to the first engaging portion 233*b* such that the second engaging portion 251 can be inserted into and engage with the first engaging portion 233*b*. However, the first engaging portion 233*b* and the second engaging portion 251 are not limited to the above configurations. In another embodiment of the present invention for example, the first engaging portion 233*b* is a recess, and the second engaging portion 251 a protruding plate. The first engaging portion 233*b* and the second engaging portion 251 can be of any configurations without departing from the scope of the present invention, provided that the two engaging portions 233*b* and 251 are engageable with each other. Referring to FIGS. 3 and 4, once the blade 21 is fully opened, and the second engaging portion 251 is moved into engagement with the first engaging portion 233*b*, the second end of the resilient locking arm 233*a* is forced to disengage from the first end of the blade 21, thus allowing the blade 21 to spin into the handle 23 and be received therein. On the other hand, once the blade 21 is completely opened, and the second engaging portion 251 is moved out of engagement with the first engaging portion 233*b*, a second lateral surface of the resilient locking arm 233*a* is pressed by the second engaging portion 251 such that the second end of the resilient locking arm 233*a* remains pressed against the first end of the blade 21 and thereby prevents the blade 21 from rotating toward the first side of the handle 23. Hence, in the course where the blade 21 is rotated out of the handle 23—during which time the second end of the resilient locking arm 233*a* is pressed against the first end of the blade 21—the restoring spring 24 pushes the second engaging portion 251 to a position where the second engaging portion 251 cannot engage with the first engaging portion 233*b*. Consequently, the second end of the resilient locking arm 233*a* is securely held in a state in which it is pressed against the first end of the blade 21 to keep the blade 21 from rotation, thereby ensuring the stability of the folding knife 2 in use. To put the blade 21 back into the handle 23, the first end of the positioning plate 25 is pushed toward the restoring spring 24 such that the positioning plate 25 is moved toward the first end of the resilient locking arm 233*a*; as a result, the second engaging portion 251 is moved into engagement with the first engaging portion 233*b*. Following that, the resilient locking arm 233*a* is pressed to disengage the second end of the resilient locking arm 233*a* from the first end of the blade 21, thus allowing the blade 21 to be rotated into and hence received in the handle 23.

Referring to FIG. 3 and FIG. 4, in the present embodiment, the third panel 235 has a lateral surface facing the second panel 233 and concavely provided with a groove 235*a*. The groove 235*a* corresponds in configuration to the positioning plate 25 such that the positioning plate 25 not only can be received in the groove 235*a* but also can be displaced along the groove 235*a* in the longitudinal direction of the resilient locking arm 233*a*. Therefore, when the user pushes the first end of the positioning plate 25 and thereby moves the positioning plate 25 toward the first end of the resilient locking arm 233*a*, the second engaging portion 251 is moved precisely into a position where it can engage with the first engaging portion 233*b*. In addition, during assembly of the folding knife 2, the positioning plate 25 and the restoring spring 24 can be readily put together by placing them into the groove 235*a*; in other words, the assembly of the positioning plate 25 and the restoring spring 24 will not significantly lengthen the overall assembly process of the folding knife 2. Furthermore, the restoring spring 24 need not be placed precisely against the second engaging portion 251 in order to push and move the positioning plate 25 along the groove 235*a*; rather, it is only necessary to place the restoring spring 24 against the second end of the positioning plate 25. Therefore, should the folding knife 2 be subjected to an external impact, the operation of the positioning plate 25 will not be adversely affected simply because the restoring spring 24 is slightly shifted in position. Thus, the stability of the blade 21 and durability of the folding knife 2 are assured. In a different embodiment of the present invention, the positioning plate 25 is additionally provided with at least one first rail element 252, and the second panel 233 is additionally provided with at least one second rail element 233*c* corresponding in both position and configuration to the at least one first rail element 252. It is also feasible to add a third rail element 253 to the positioning plate 25, and at least one fourth rail element 235*b* to the third panel 235, wherein the at least one fourth rail element 235*b* corresponds in both position and configuration to the third rail element 253. The positioning plate 25 can be displaced along the rail elements 233*c*, 252, 253, 235*b* precisely in the longitudinal direction of the resilient locking arm 233*a* and hence work smoothly and stably. In this sense, the rail elements 233*c*, 252, 253, 235*b* serve the same purpose as the groove 235*a*.

With reference to FIGS. 3 and 4, the folding knife 2 in the present preferred embodiment further includes a pushing element 26 corresponding in configuration to the first end of the positioning plate 25. More particularly, the pushing element 26 is fixedly provided at the first end of the positioning plate 25 and is extended out of one end of the handle 23. By pushing the pushing element 26 toward the restoring spring 24, the first end of the positioning plate 25 is driven, and the entire positioning plate 25 is moved along the longitudinal direction of the resilient locking arm 233*a*. The folding knife 2 further includes a cover 27. The cover 27 is mounted on the first panel 231 and has an outer surface protrudingly provided with a plurality of relief structures 271. The relief structures 271 serve to increase the friction between the handle 23 and the user's hand holding the folding knife 2, with a view to enhancing the stability of the folding knife 2 during use.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A folding knife, comprising:

a blade;

a pivot;

a handle comprising a first panel, a second panel, and a third panel, wherein a portion of the blade that is adjacent to a first end thereof is pivotally connected between the first panel and the second panel by the pivot at a position adjacent to an end of the handle, such that a second end of the blade is rotatable about the pivot and can be rotated out of the handle or be rotated into and received in the handle, the second panel being provided with a resilient locking arm, the resilient locking arm having a first end fixed to the second panel and a second end extending slantingly toward the first panel, wherein while the blade is being rotated out of the handle, a lateral surface of the resilient locking arm that is adjacent to the second end thereof is pressed against a lateral surface of the blade, and once the blade is rotated out of the handle completely, the second end of the resilient locking arm is pressed against the first end of the blade to secure the blade in a fully opened state, the resilient locking arm further having a first engaging portion; and a positioning plate movably positioned between the second panel and the third panel, corresponding in position to the resilient locking arm, and displaceable along a longitudinal direction of the resilient locking arm, the positioning plate having a first end jutting out of the handle, there being a restoring spring disposed between a second end of the positioning plate and the second panel or the third panel, the positioning plate further having a second engaging portion corresponding in configuration to the first engaging portion, wherein when the blade is fully opened and the second engaging portion is moved into engagement with the first engaging portion, the second end of the resilient locking arm is forced to disengage from the first end of the blade, thus allowing the blade to be rotated into and received in the handle, and when the blade is fully opened and the second engaging portion is moved out of engagement with the first engaging portion, the second engaging portion presses against the resilient locking arm such that the second end of the resilient locking arm remains pressed against the first end of the blade and thereby prevents the blade form being rotated into and received in the handle.

2. The folding knife of claim 1, wherein the third panel has a lateral surface facing the second panel and concavely provided with a groove, the groove corresponding in configuration to the positioning plate such that the positioning plate can be received in the groove and be displaced along the groove in the longitudinal direction of the resilient locking arm.

3. The folding knife of claim 1, wherein the positioning plate is provided with a first rail element, and the second panel is provided with a second rail element corresponding in position and configuration to the first rail element, so as for the positioning plate to be displaced along the rail elements in the longitudinal direction of the resilient locking arm.

4. The folding knife of claim 1, wherein the positioning plate is provided with a rail element, and the third panel is provided with a rail element corresponding in position and configuration to the rail element of the positioning plate, so as for the positioning plate to be displaced along the rail elements in the longitudinal direction of the resilient locking arm.

5. The folding knife of claim 1, further comprising a pushing element, wherein the pushing element is extended out of the handle and fixed to the first end of the positioning plate such that, when the pushing element is pushed toward the restoring spring, the positioning plate is displaced in the longitudinal direction of the resilient locking arm.

6. The folding knife of claim 2, further comprising a pushing element, wherein the pushing element is extended out of the handle and fixed to the first end of the positioning plate such that, when the pushing element is pushed toward the restoring spring, the positioning plate is displaced in the longitudinal direction of the resilient locking arm.

7. The folding knife of claim 3, further comprising a pushing element, wherein the pushing element is extended out of the handle and fixed to the first end of the positioning plate such that, when the pushing element is pushed toward the restoring spring, the positioning plate is displaced in the longitudinal direction of the resilient locking arm.

8. The folding knife of claim 4, further comprising a pushing element, wherein the pushing element is extended out of the handle and fixed to the first end of the positioning plate such that, when the pushing element is pushed toward the restoring spring, the positioning plate is displaced in the longitudinal direction of the resilient locking arm.

9. The folding knife of claim 5, wherein the first engaging portion is a recess, and the second engaging portion is a protruding member corresponding in configuration to the recess such that, when the protruding member and the recess are at corresponding positions, the protruding member is inserted into the recess, thereby bringing the first engaging portion and the second engaging portion into engagement.

10. The folding knife of claim 6, wherein the first engaging portion is a recess, and the second engaging portion is a protruding member corresponding in configuration to the recess such that, when the protruding member and the recess are at corresponding positions, the protruding member is inserted into the recess, thereby bringing the first engaging portion and the second engaging portion into engagement.

11. The folding knife of claim 7, wherein the first engaging portion is a recess, and the second engaging portion is a protruding member corresponding in configuration to the recess such that, when the protruding member and the recess are at corresponding positions, the protruding member is inserted into the recess, thereby bringing the first engaging portion and the second engaging portion into engagement.

12. The folding knife of claim 8, wherein the first engaging portion is a recess, and the second engaging portion is a protruding member corresponding in configuration to the recess such that, when the protruding member and the recess are at corresponding positions, the protruding member is inserted into the recess, thereby bringing the first engaging portion and the second engaging portion into engagement.

13. The folding knife of claim 9, wherein the second panel is provided with a post adjacent to an end of the second panel such that, when the blade is rotated out of the handle completely, the post presses against a side of the blade and thereby prevents the blade from rotating toward the handle, and once the blade is rotated into the handle and received therein, the post presses against an opposite side of the blade and thereby secures the blade in position in the handle.

14. The folding knife of claim 10, wherein the second panel is provided with a post adjacent to an end of the second panel such that, when the blade is rotated out of the handle completely, the post presses against a side of the blade and thereby prevents the blade from rotating toward the handle, and once the blade is rotated into the handle and received therein, the post presses against an opposite side of the blade and thereby secures the blade in position in the handle.

15. The folding knife of claim 11, wherein the second panel is provided with a post adjacent to an end of the second panel such that, when the blade is rotated out of the handle completely, the post presses against a side of the blade and thereby prevents the blade from rotating toward the handle, and once the blade is rotated into the handle and received therein, the post presses against an opposite side of the blade and thereby secures the blade in position in the handle.

16. The folding knife of claim 12, wherein the second panel is provided with a post adjacent to an end of the second panel such that, when the blade is rotated out of the handle completely, the post presses against a side of the blade and thereby prevents the blade from rotating toward the handle, and once the blade is rotated into the handle and received therein, the post presses against an opposite side of the blade and thereby secures the blade in position in the handle.

* * * * *